US009431737B2

(12) United States Patent
Onodera et al.

(10) Patent No.: US 9,431,737 B2
(45) Date of Patent: Aug. 30, 2016

(54) FITTING TYPE CONNECTING TERMINAL AND METHOD FOR PRODUCING SAME

(71) Applicants: DOWA METALTECH CO., LTD., Tokyo (JP); YAZAKI CORPORATION, Tokyo (JP)

(72) Inventors: Akifumi Onodera, Shizuoka (JP); Masatoshi Nakamura, Shizuoka (JP); Akira Sigawara, Shizuoka (JP); Hiroto Narieda, Shizuoka (JP)

(73) Assignees: DOWA METALTECH CO., LTD., Tokyo (JP); YAZAKI CORPORATION, Tokyo (JP)

( * ) Notice: Subject to any disclaimer, the term of this patent is extended or adjusted under 35 U.S.C. 154(b) by 65 days.

(21) Appl. No.: 14/351,586

(22) PCT Filed: Oct. 10, 2012

(86) PCT No.: PCT/JP2012/076747

§ 371 (c)(1),
(2) Date: Apr. 14, 2014

(87) PCT Pub. No.: WO2013/054941

PCT Pub. Date: Apr. 18, 2013

(65) Prior Publication Data

US 2014/0248809 A1 Sep. 4, 2014

(30) Foreign Application Priority Data

Oct. 14, 2011 (JP) ..... 2011-226376
Oct. 3, 2012 (JP) ..... 2012-221577

(51) Int. Cl.
*H01R 13/02* (2006.01)
*H01R 13/03* (2006.01)
(Continued)

(52) U.S. Cl.
CPC ..... *H01R 13/02* (2013.01); *H01R 13/03* (2013.01); *H01R 43/16* (2013.01); *H01R 13/187* (2013.01); *Y10T 29/49224* (2015.01)

(58) Field of Classification Search
CPC ..... H01R 13/02; H01R 13/03; H01R 13/68; H01R 43/16; H01R 43/24
USPC ..... 439/886, 323, 647
See application file for complete search history.

(56) References Cited

U.S. PATENT DOCUMENTS 5,235,743 A * 8/1993 Endo ..... H01R 13/03 29/874
7,131,855 B2 11/2006 Saitoh
(Continued)

FOREIGN PATENT DOCUMENTS

JP 2001035578 A 2/2001
JP 2001266990 A 9/2001
(Continued)

OTHER PUBLICATIONS

European Search Report for Application No. 12839543.1 dated May 6, 2015.

*Primary Examiner* — Hien Vu
(74) *Attorney, Agent, or Firm* — Bachman & LaPointe, P.C.

(57) ABSTRACT

In a fitting type connecting terminal having male and female terminals, each of which has a tin plating layer formed on an electrically conductive base material, a surface of a contact portion of one of the male and female terminals with the other thereof has a plurality of grooves or recessed portions which are spaced from each other in longitudinal directions, and the grooves or recessed portions are formed so as to satisfy $d \leq b$, $d \leq a \leq L$ and $a+c \leq L$ assuming that the width of each of the grooves or recessed portions is $\underline{a}$ (μm), the depth thereof being $\underline{b}$ (μm), the distance between two of the grooves or recessed portions adjacent to each other in the longitudinal directions being $\underline{c}$ (μm), the sliding distance producible between the male terminal and the female terminal in a state that the male terminal is fitted into and fixed to the female terminal being $\underline{L}$ (μm), and the maximum grain size of the oxide of abrasion powder producible due to sliding between the male terminal and the female terminal being $\underline{d}$ (μm).

17 Claims, 5 Drawing Sheets

(51) Int. Cl.
*H01R 43/16* (2006.01)
*H01R 13/187* (2006.01)

(56) References Cited

U.S. PATENT DOCUMENTS

| | | | | |
|---|---|---|---|---|
| 8,728,629 | B2 * | 5/2014 | Kitagawa | C25D 5/10 148/525 |
| 2011/0003520 | A1 | 1/2011 | Kitagawa et al. | |
| 2015/0236439 | A1 * | 8/2015 | Okubo | H01R 13/11 439/886 |

FOREIGN PATENT DOCUMENTS

| | | | |
|---|---|---|---|
| JP | 2004111081 | A | 4/2004 |
| JP | 2005141993 | A | 6/2005 |
| JP | 2006080004 | A | 3/2006 |
| JP | 2006134681 | A | 5/2006 |
| JP | 2006134682 | A | 5/2006 |
| JP | 2006172877 | A | 6/2006 |
| JP | 2008041315 | A | 2/2008 |
| JP | 2009266499 | A | 12/2009 |
| JP | 2010037629 | A | 2/2010 |
| WO | 2008001459 | A1 | 1/2008 |
| WO | 2009116602 | A1 | 9/2009 |

* cited by examiner

FITTING TYPE CONNECTING TERMINAL AND METHOD FOR PRODUCING SAME

TECHNICAL FIELD

The present invention relates generally to a fitting type connecting terminal (fitting type connector) and a method for producing the same. More specifically, the invention relates to a fitting type connecting terminal having a tin plating layer formed on a surface of each of male and female terminals, one of which is fitted into the other terminal, and a method for producing the same.

BACKGROUND ART

As conventional materials of fitting type connecting terminals wherein one of male and female terminals is fitted into the other terminal, there are used tin-plated products wherein a tin plating layer is formed as the outermost layer on a conductive material, such as copper or a copper alloy. In particular, tin-plated products have a small contact resistance, and are used as the materials of various connecting terminals for automotive vehicles, information and communication apparatuses, industrial apparatuses and so forth, from the standpoint of contact reliability, corrosion resistance, solderability, economical efficiency and so forth.

In recent years, connecting terminals for automotive vehicles and so forth are miniaturized, so that the thickness of spring portions thereof is decreased. In addition, it is not possible to sufficiently ensure spring displacement, so that the contact load at the contact point between male and female terminals is decreased. Particularly in fitting type connecting terminals of tin-plated products, if the contact load at the contact point between male and female terminals is decreased, there is a problem in that the contact reliability thereof is deteriorated by minute sliding abrasion due to minute sliding at the contact point.

In order to eliminate this problem, it is proposed to form an Ag—Sn alloy layer on the surface of a tin plating layer, which is formed on a base material of a small terminal, to suppress the rise of electric contact resistance due to the minute sliding abrasion of the small terminal to enhance the electric connection reliability thereof (see, e.g., Japanese Patent Laid-Open No. 2010-37629).

It is also proposed to provide a reinforcing member having a spring piece for reinforcing the contact pressure of a contact piece to obtain a strong contact pressure at which it is difficult to cause minute sliding abrasion due to vibration (see, e.g., Japanese Patent laid-Open No. 2006-134681), and to provide a holding portion for holding the tip portion of a tab of a mating terminal in a relative displacement regulated state to prevent the minute sliding abrasion between terminal fittings (see, e.g., Japanese Patent Laid-Open No. 2006-80004).

Moreover, it is proposed to provide prismatic protruding portions on an electric contact of one connector of an electric connector assembly to cause the electric contact of the other connector to slide thereon, so that it is difficult to allow impurities, such as solder, to adhere to the electric contact of the electric connector while it is difficult to cause contact failure (see, e.g., Japanese Patent Laid-Open No. 2001-266990). It is also proposed to cause the sliding distance producible between the male and female terminals in a state that a male connector is fitted into and fixed to a female connector to be less than the range of contact flaws in a contact range in which the contact portion of the male terminal contacts that of the female terminal, so that contact reliability is prevented from being deteriorated even under a high sliding environment (see, e.g., Japanese Patent Laid-Open No. 2005-141993).

However, as described in Japanese Patent Laid-Open No. 2010-37629 in which the Ag—Sn alloy layer is formed on the surface of the tin plating layer, if a conductive material is plated with an expensive noble metal, such as Au or Ag, as the outermost thereof or if a high strength material is used as a conductive material to increase contact load, the costs thereof are very high.

Also, even if the movement of the contact portion is prevented by the structure of the terminal so as to prevent sliding as described in Japanese Patent Laid-Open Nos. 2006-134682 and 2006-80004, if the contact load decreases in a fitting type connecting terminal of a tin-plated product, the contact point is easy to move, so that it is difficult to suppress the minute sliding abrasion due to minute sliding.

Moreover, if the prismatic protruding portions are provided on the electric contact of one connector of the electric connector assembly as described in Japanese Patent Laid-Open No. 2001-266990, or if the sliding distance producible between the male and female terminals while a male connector is fitted into and fixed to a female connector is caused to be less than the range of contact flaws in a contact range in which the contact portion of the male terminal contacts that of the female terminal as described in Japanese Patent Laid-Open No. 2005-141993, it is not possible to sufficiently prevent oxides of abrasion powder of Sn plating produced during minute sliding from being accumulated on the contact portion to restrain the minute sliding abrasion in a fitting type connecting terminal of a tin-plated product.

DISCLOSURE OF THE INVENTION

It is therefore an object of the present invention to eliminate the aforementioned problems and to provide a fitting type connecting terminal, which can inexpensively and sufficiently restrain the rise of the value of electrical resistance due to minute sliding abrasion, the fitting type connecting terminal comprising male and female terminals, each of which has a tin plating layer formed on an electrically conductive base material.

In order to accomplish the aforementioned and other objects, the inventors have diligently studied and found that it is possible to produce a fitting type connecting terminal, which can inexpensively and sufficiently restrain the rise of the value of electrical resistance due to minute sliding abrasion, if the fitting type connecting terminal comprises a male terminal and a female terminal, each of the male and female terminals having a tin plating layer formed on an electrically conductive base material, wherein a surface of a contact portion of one of the male and female terminals with the other thereof has a plurality of grooves or recessed portions which are spaced from each other in longitudinal directions of the one thereof, and wherein the grooves or recessed portions are formed so as to satisfy $d \leq b$, $d \leq a \leq L$ and $a+c \leq L$ assuming that the width of each of the grooves or recessed portions is $\underline{a}$ (μm), the depth thereof being $\underline{b}$ (μm), the distance between two of the grooves or recessed portions adjacent to each other in the longitudinal directions being $\underline{c}$ (μm), the sliding distance producible between the male terminal and the female terminal in a state that the male terminal is fitted into and fixed to the female terminal being $\underline{L}$ (μm), and the maximum grain size of the oxide of abrasion powder producible due to sliding between the male terminal and the female terminal being $\underline{d}$ (μm). Thus, the inventors have made the present invention.

According to the present invention, there is provided a fitting type connecting terminal comprising a male terminal and a female terminal, each of the male and female terminals having a tin plating layer formed on an electrically conductive base material, wherein a surface of a contact portion of one of the male and female terminals with the other thereof has a plurality of grooves or recessed portions which are spaced from each other in longitudinal directions of the one thereof, and wherein the grooves or recessed portions are formed so as to satisfy $d \leq b$, $d \leq a \leq L$ and $a+c \leq L$ assuming that the width of each of the grooves or recessed portions is $\underline{a}$ (μm), the depth thereof being $\underline{b}$ (μm), the distance between two of the grooves or recessed portions adjacent to each other in the longitudinal directions being $\underline{c}$ (μm), the sliding distance producible between the male terminal and the female terminal in a state that the male terminal is fitted into and fixed to the female terminal being $\underline{L}$ (μm), and the maximum grain size of the oxide of abrasion powder producible due to sliding between the male terminal and the female terminal being $\underline{d}$ (μm).

In this fitting type connecting terminal, the plurality of grooves are preferably elongated grooves which are spaced from each other at substantially even intervals in longitudinal directions of the male terminal and which extend in width directions thereof, each of the grooves having a substantially rectangular planar shape. The plurality of recessed portions are preferably spaced from each other at substantially even intervals in longitudinal directions of the male terminal and spaced from each other at substantially even intervals in width directions thereof, the corner portions of each of the recessed portions being arranged so as to be adjacent to those of an adjacent one or more of the recessed portions, and each of the recessed portions having a substantially rectangular planar shape. The base material is preferably made of copper or a copper alloy, and the tin plating layer is preferably made of tin having a purity of 99.9 wt % or more. The fitting type connecting terminal is preferably a box-shaped connecting terminal having an elastic piece which is provided with the contact portion of the male terminal. The sliding distance $\underline{L}$ is preferably 1000 μm, and the maximum grain size $\underline{d}$ is preferably 10 μm. The sliding distance $\underline{L}$ is more preferably 250 μm, and the maximum grain size $\underline{d}$ is more preferably 30 μm.

According to the present invention, there is provided a method for producing a fitting type connecting terminal which comprises a male terminal and a female terminal, each of the male and female terminals having a tin plating layer formed on an electrically conductive base material, the method comprising the steps of: forming grooves or recessed portions, which are spaced from each other in longitudinal directions, in a portion of a surface of the electrically conductive base material of one of the male and female terminals corresponding to a contact portion of the one thereof with the other thereof so that $d \leq b$, $d \leq a \leq L$ and $a+c \leq L$ are satisfied assuming that the width of each of the grooves or the recessed portions is $\underline{a}$ (μm), the depth thereof being $\underline{b}$ (μm), the distance between two of the grooves or recessed portions adjacent to each other in the longitudinal directions being $\underline{c}$ (μm), the sliding distance producible between the male terminal and the female terminal in a state that the male terminal is fitted into and fixed to the female terminal being $\underline{L}$ (μm), and the maximum grain size of the oxide of abrasion powder producible due to sliding between the male terminal and the female terminal being $\underline{d}$ (μm); and thereafter, forming a tin plating layer on the electrically conductive base material of each of the male and female terminals.

Alternatively, according to the present invention, there is provided a method for producing a fitting type connecting terminal which comprises a male terminal and a female terminal, each of the male and female terminals having a tin plating layer formed on an electrically conductive base material, the method comprising the steps of: forming a tin plating layer on the electrically conductive base material of each of the male and female terminals; and thereafter, forming grooves or recessed portions, which are spaced from each other in longitudinal directions, in a surface of a contact portion of one of the male and female terminals with the other thereof so that $d \leq b$, $d \leq a \leq L$ and $a+c \leq L$ are satisfied assuming that the width of each of the grooves or the recessed portions is $\underline{a}$ (μm), the depth thereof being $\underline{b}$ (μm), the distance between two of the grooves or recessed portions adjacent to each other in the longitudinal directions being $\underline{c}$ (μm), the sliding distance producible between the male terminal and the female terminal in a state that the male terminal is fitted into and fixed to the female terminal being $\underline{L}$ (μm), and the maximum grain size of the oxide of abrasion powder producible due to sliding between the male terminal and the female terminal being $\underline{d}$ (μm).

In these methods for producing a fitting type connecting terminal, the plurality of grooves are preferably elongated grooves which are spaced from each other at substantially even intervals in longitudinal directions of the male terminal and which extend in width directions thereof, each of the grooves having a substantially rectangular planar shape. The plurality of recessed portions are preferably spaced from each other at substantially even intervals in longitudinal directions of the male terminal and spaced from each other at substantially even intervals in width directions thereof, the corner portions of each of the recessed portions being arranged so as to be adjacent to those of an adjacent one or more of the recessed portions, and each of the recessed portions having a substantially rectangular planar shape. The base material is preferably made of copper or a copper alloy, and the tin plating layer is preferably made of tin having a purity of 99.9 wt % or more. The fitting type connecting terminal is preferably a box-shaped connecting terminal having an elastic piece which is provided with the contact portion of the male terminal. The sliding distance $\underline{L}$ is preferably 1000 μm, and the maximum grain size $\underline{d}$ is preferably 10 μm. The sliding distance $\underline{L}$ is more preferably 250 μm, and the maximum grain size $\underline{d}$ is more preferably 30 μm.

According to the present invention, it is possible to inexpensively and sufficiently restrain the rise of the value of electrical resistance due to minute sliding abrasion, the fitting type connecting terminal comprising male and female terminals, each of which has a tin plating layer formed on an electrically conductive base material.

BEST MODE FOR CARRYING OUT THE INVENTION

Referring to the accompanying drawings, the preferred embodiment of a fitting type connecting terminal and a method for producing the same according to the present invention will be described below in detail.

Figure 1A:
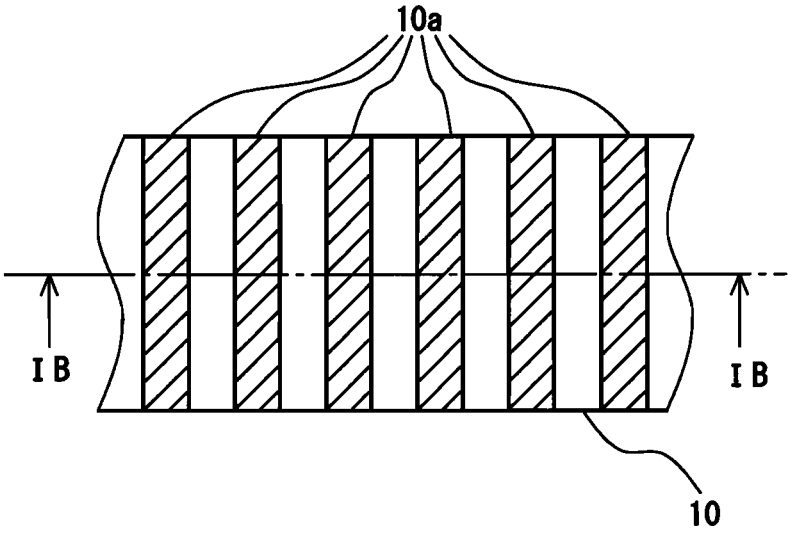
FIG. 1A is a plan view of a contact portion of a male terminal with a female terminal in a preferred embodiment of a fitting type connecting terminal according to the present invention.
Figure 1B:
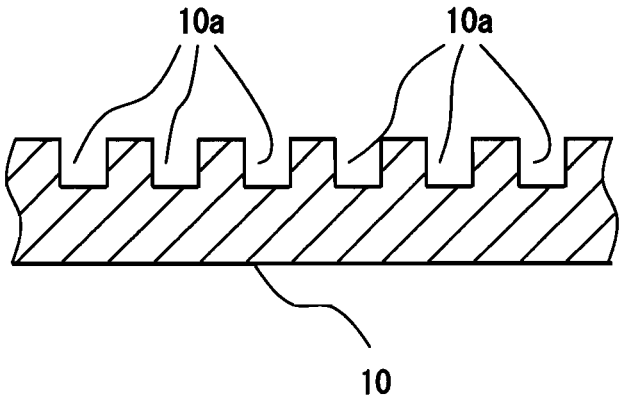
FIG. 1B is a sectional view taken along line IB-IB of FIG. 1A.
Figure 1C:
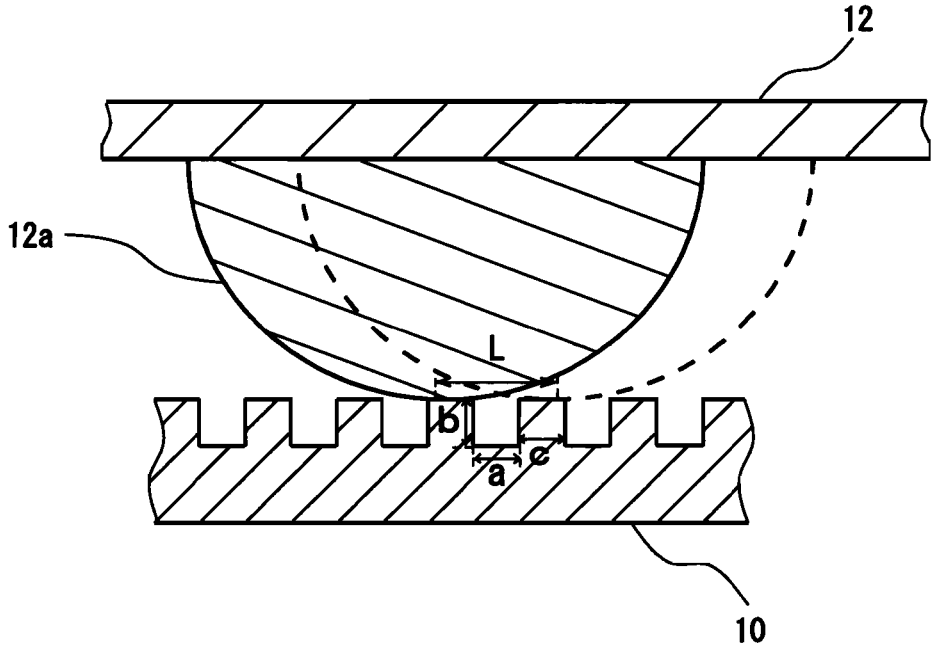
FIG. 1C is a sectional view showing the contact portion of the male terminal of FIG. 1A with the female terminal in the preferred embodiment of a fitting type connecting terminal according to the present invention.

As shown in FIGS. 1A through 1C, the preferred embodiment of a fitting type connecting terminal according to the present invention comprises a male terminal 10 and a female terminal 12, one of which is able to be fitted into the other thereof. On the surface of an electrically conductive base material of each of the male terminal 10 and female terminal 12, there is formed a tin plating layer (of Sn preferably having a purity of 99.9 wt % or more). On the surface of a contact portion of the male terminal 10 with (the semi-spherical indent 12*a* of) the female terminal 12, there are formed a large number of fine grooves 10*a* which are spaced from each other at substantially even intervals in longitudinal directions of the male terminal 10 and which extend in width directions (lateral directions) thereof, each of the grooves 10*a* substantially having elongated rectangular planar and sectional shapes.

The grooves 10*a* are formed so as to satisfy $d \leq b$, $d \leq a \leq L$ and $a+c \leq L$, assuming that the width of each of the grooves 10*a* (the length thereof in longitudinal directions of the male terminal 10) is $\underline{a}$, the depth thereof being $\underline{b}$, the distance between two of the grooves 10*a* adjacent to each other in the longitudinal directions being $\underline{c}$, the sliding distance producible between the male terminal 10 and the female terminal 12 in a state (fitted/fixed state) that the male terminal 10 is fitted into and fixed to the female terminal 12 being $\underline{L}$, and the maximum grain size of the oxide of abrasion powder producible due to sliding between the male terminal 10 and the female terminal 12 being $\underline{d}$.

Specifically, the grooves 10*a* are formed so as to satisfy 10 (μm)≤b, 10 (μm)≤a≤1000 (μm) and a+c≤1000 (μm) where the sliding distance L producible between the male terminal 10 and the female terminal 12 in the state that the male terminal 10 is fitted into and fixed to the female terminal 12 is set to be 1000 (μm) and where the maximum grain size $\underline{d}$ of the oxide of abrasion powder producible due to sliding between the male terminal 10 and the female terminal 12 is set to be 10(μm). Preferably, the grooves 10*a* are formed so as to satisfy 30 (μm)≤b, 30 (μm)≤a≤250 (μm) and a+c≤250 (μm) where the sliding distance L is set to be 250 (μm) and where the maximum grain size $\underline{d}$ of the oxide of abrasion powder is set to be 30 (μm).

Figure 2A:
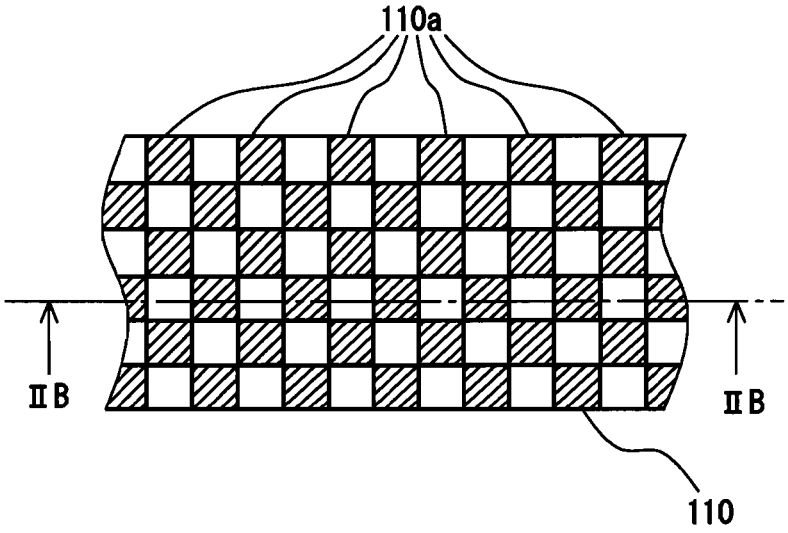
FIG. 2A is a view showing a planar shape of a modified example of a contact portion of the male terminal of FIG. 1A with a female terminal.
Figure 2B:
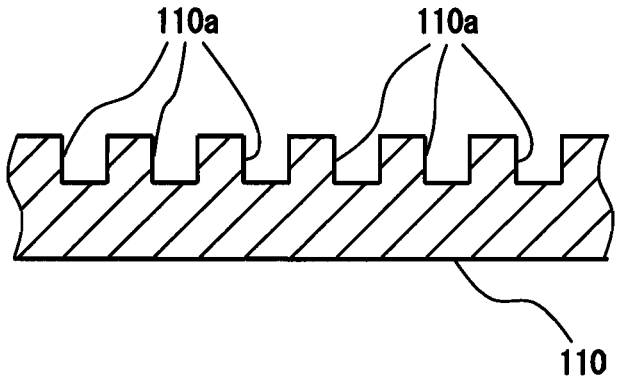
FIG. 2B is a sectional view taken along line IIB-IIB of FIG. 2A.

In place of the male terminal 10 having the grooves 10*a*, as shown in FIGS. 2A and 2B, there may be used a male terminal 110 having a large number of fine recessed portions 110*a* which are spaced from each other at substantially even intervals in longitudinal directions of the male terminal 110 and which are spaced from each other at substantially even intervals in width directions (lateral directions) thereof, the corner portions of each of the recessed portions 110*a* being arranged so as to be adjacent to (or substantially contact) those of an adjacent one or more of the recessed portions 110*a*, and each of the recessed portions 110*a* having substantially rectangular planar and sectional shapes.

These recessed portions 110*a* are formed so as to satisfy $d \leq b$, $d \leq a \leq L$ and $a+c \leq L$ assuming that the width of each of the recessed portions 110*a* (the length thereof in longitudinal directions of the male terminal 110) is $\underline{a}$, the depth thereof being $\underline{b}$, the distance between two of the recessed portions 110*a* adjacent to each other in the longitudinal directions being $\underline{c}$, the sliding distance producible between the male terminal 110 and the female terminal 12 in a state that the male terminal 110 is fitted into and fixed to the female terminal 12 being $\underline{L}$, and the maximum grain size of the oxide of abrasion powder producible due to sliding between the male terminal 110 and the female terminal 12 being $\underline{d}$.

Specifically, the recessed portions 110*a* are formed so as to satisfy 10 (μm)≤b, 10 (μm)≤a≤1000 (μm) and a+c≤1000 (μm) where the sliding distance L producible between the male terminal 110 and the female terminal 12 in the state that the male terminal 110 is fitted into and fixed to the female terminal 12 is set to be 1000 (μm) and where the maximum grain size $\underline{d}$ of the oxide of abrasion powder producible due to sliding between the male terminal 110 and the female terminal 12 is set to be 10 (μm). Preferably, the recessed portions 110*a* are formed so as to satisfy 30 (μm)≤b, 30 (μm)≤a≤250 (μm) and a+c≤250 (μm) where the sliding distance L is set to be 250 (μm) and where the maximum grain size $\underline{d}$ of the oxide of abrasion powder is set to be 30 (μm).

The reason why the sliding distance L is set to be 1000 (μm), preferably 250 (μm), is that the sliding distance L producible between the male terminal 10 or 110 and the female terminal 12 in the state that the male terminal 10 or 110 is fitted into and fixed to the female terminal 12 (in the state that a minute load (of 3N or less) is applied between the male terminal 10 or 110 and the female terminal 12) is in the range of from 30 μm to 1000 μm, usually in the range of from 50 μm to 250 μm. The reason why the maximum grain size $\underline{d}$ of the oxide of abrasion powder is set to be 10 (μm), preferably 30 (μm), is that it was found that the grain size of the oxide of abrasion powder is not greater than 10 μm and does not exceed 30 μm even if the oxide aggregates, although the maximum grain size $\underline{d}$ of the oxide of abrasion powder is usually about 3 μm.

If the grooves 10*a* or the recessed portions 110*a* are thus formed, the oxide of abrasion powder produced between the male terminal 10 or 110 and the female terminal 12 in the state that the male terminal 10 or 110 is fitted into and fixed to the female terminal 12 is designed to fall into the grooves 10*a* or recessed portions 110*a*. Thus, it is possible to prevent the oxide of abrasion powder from being accumulated on the surface of the contact portion of the male terminal 10 or 110 with the female terminal 12, so that it is possible to suppress the rise of the value of electrical resistance due to minute sliding abrasion to enhance electric connection reliability.

Between the tin plating layer and the surface of the electrically conductive base material of each of the male terminal 10 or 110 and female terminal 12 of the fitting type connecting terminal, Ni and Cu plating layers may be formed in that order, or Ni, Cu and CuSn plating layers may be formed in that order, from the side of the electrically conductive base material to the side of the tin plating layer. Alternatively, a CuSn or Ni plating layer may be formed.

The electrically conductive base material of each of the male terminal 10 or 110 and female terminal 12 of the fitting type connecting terminal is preferably made of copper or a copper alloy, and may be made of a Cu—Ni—Sn alloy (a copper alloy, such as NB-109 or NB-105 produced by DOWA METALTECH CO., LTD., for example), phosphor bronze, brass or the like. Although the electrically conductive base material of the male terminal 10 or 110 may be made of a high-strength copper alloy, such as a copper-beryllium alloy or a copper-titanium alloy, such a copper alloy is expensive. Therefore, the electrically conductive base material of the male terminal 10 or 110 is preferably made of a relatively inexpensive electrically conductive base material of a Cu—Ni—Si alloy (Corson alloy), a Cu—Ni—Sn alloy, phosphor bronze or the like. The electrically conductive base material of the female terminal 12 is preferably made of brass. Alternatively, the electrically conductive base material of each of the male terminal 10 or 110 and the female terminal 12 may be made of an iron material, such as stainless (SUS), an aluminum alloy or the like.

In the preferred embodiment of a method for producing a fitting type connecting terminal according to the present invention, in a portion of the surface of the electrically conductive base material of the male terminal 10 or 110 corresponding to the contact portion thereof with the female terminal 12, there are formed the grooves 10*a*, which are spaced from each other at substantially even intervals in longitudinal directions and which extend in width directions (lateral directions), each of the grooves 10*a* substantially having elongated rectangular planar and sectional shapes, or the recessed portions 110*a*, which are spaced from each other at substantially even intervals in longitudinal directions and which are spaced from each other at substantially even intervals in width directions (lateral directions), the corner portions of each of the recessed portions 110*a* being arranged so as to be adjacent to (or substantially contact) those of an adjacent one of the recessed portions 110*a*, and each of the recessed portions 110*a* having substantially rectangular planar and sectional shapes. The grooves 10*a* or the recessed portions 110*a* are formed so as to satisfy $d \leq b$, $d \leq a \leq L$ and $a+c \leq L$ assuming that the width of each of the grooves 10*a* or the recessed portions 110*a* is $\underline{a}$, the depth thereof being $\underline{b}$, the distance between two of the grooves 10*a* or recessed portions 110*a* adjacent to each other in the longitudinal directions being $\underline{c}$, the sliding distance producible between the male terminal 10 or 110 and the female terminal 12 in the state that the male terminal 10 or 110 is fitted into and fixed to the female terminal 12 being L, and the maximum grain size of the oxide of abrasion powder producible due to sliding between the male terminal 10 or 110 and the female terminal 12 being $\underline{d}$. Thereafter, a tin plating layer is formed on the electrically conductive base material of each of the male terminal 10 or 110 and the female terminal 12.

Alternatively, a tin plating layer is formed on the electrically conductive base material of each of the male terminal 10 or 110 and the female terminal 12. Thereafter, in a portion of the surface of the contact portion of the male terminal 10 or 110 with the female terminal 12, there are formed the grooves 10*a*, which are spaced from each other at substantially even intervals in longitudinal directions and which extend in width directions (lateral directions), each of the grooves 10*a* substantially having elongated rectangular planar and sectional shapes, or the recessed portions 110*a*, which are spaced from each other at substantially even intervals in longitudinal directions and which are spaced from each other at substantially even intervals in width directions (lateral directions), the corner portions of each of the recessed portions 110*a* being arranged so as to be adjacent to (or substantially contact) those of an adjacent one of the recessed portions 110*a*, and each of the recessed portions 110*a* having substantially rectangular planar and sectional shapes. The grooves 10*a* or the recessed portions 110*a* are formed so as to satisfy $d \leq b$, $d \leq a \leq L$ and $a+c \leq L$ assuming that the width of each of the grooves 10*a* or the recessed portions 110*a* is $\underline{a}$, the depth thereof being $\underline{b}$, the distance between two of the grooves 10*a* or recessed portions 110*a* adjacent to each other in the longitudinal directions being $\underline{c}$, the sliding distance producible between the male terminal 10 or 110 and the female terminal 12 in the state that the male terminal 10 or 110 is fitted into and fixed to the female terminal 12 being $\underline{L}$, and the maximum grain size of the oxide of abrasion powder producible due to sliding between the male terminal 10 or 110 and the female terminal 12 being $\underline{d}$.

In these methods for producing a fitting type connecting terminal, the grooves 10*a* are specifically formed so as to satisfy 10 (μm)≤b, 10 (μm)≤a≤1000 (μm) and a≤c≤1000 (μm) where the sliding distance L producible between the male terminal 10 and the female terminal 12 in the state that the male terminal 10 is fitted into and fixed to the female terminal 12 is set to be 1000 (μm) and where the maximum grain size $\underline{d}$ of the oxide of abrasion powder producible due to sliding between the male terminal 10 and the female terminal 12 is set to be 10 (μm). Preferably, the grooves 10*a* are formed so as to satisfy 30 (μm)≤b, 30 (μm)≤a≤250 (μm) and a+c≤250 (μm) where the sliding distance L is set to be 250 (μm) and where the maximum grain size $\underline{d}$ of the oxide of abrasion powder is set to be 30 (μm). The recessed portions 110*a* are specifically formed so as to satisfy 10 (μm)≤b, 10 (μm)≤a≤1000 (μm) and a+c≤1000 (μm) where the sliding distance L producible between the male terminal 110 and the female terminal 12 in the state that the male terminal 110 is fitted into and fixed to the female terminal 12 is set to be 1000 (μm) and where the maximum grain size $\underline{d}$ of the oxide of abrasion powder producible due to sliding between the male terminal 110 and the female terminal 12 is set to be 10 (μm). Preferably, the recessed portions 10*a* are formed so as to satisfy 30 (μm)≤b, 30 (μm)≤a≤250 (μm) and a+c≤250 (μm) where the sliding distance L is set to be 250 (μm) and where the maximum grain size $\underline{d}$ of the oxide of abrasion powder is set to be 30 (μm).

The grooves 10*a* or the recessed portions 110*a* may be formed by the press working, etching, electrical discharge machining, cutting or laser beam machining of a portion corresponding to the contact portion of the surface of the electrically conductive base material (the tin plating layer where the tin plating is carried out before forming the grooves 10*a* or the recessed portions 110*a*) of the male terminal 10 or 110 with the female terminal 12 after the male terminal 10 or 110 is formed in a terminal shape by press working. Alternatively, the grooves 10*a* or the recessed portions 110*a* may be formed when the tinplating is carried out. In this case, the tin plating is preferably carried out by electroplating from the standpoint of the costs thereof, and reflow may be carried out if necessary.

Figure 3A:
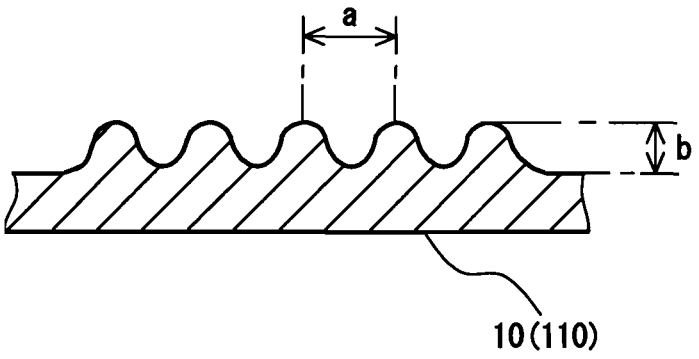
FIG. 3A is a view showing a first modified example of a sectional shape of a contact portion of the male terminal of FIGS. 1A and 2A with a female terminal.
Figure 3B:
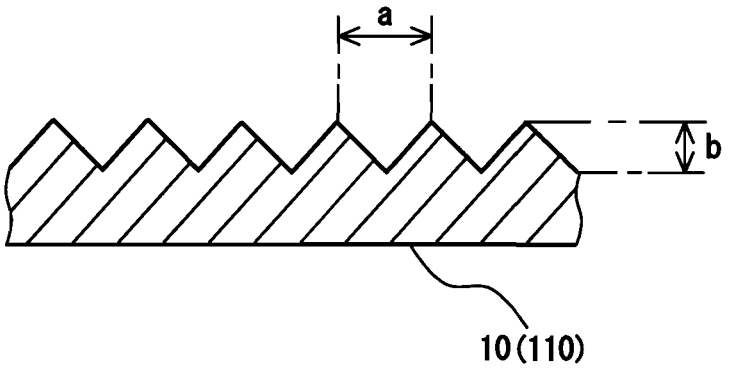
FIG. 3B is a view showing a second modified example of a sectional shape of a contact portion of the male terminal of FIGS. 1A and 2A with a female terminal.
Figure 3C:
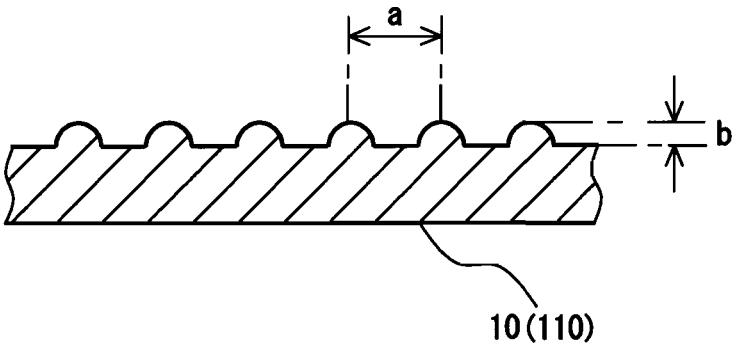
FIG. 3C is a view showing a third modified example of a sectional shape of a contact portion of the male terminal of FIGS. 1A and 2A with a female terminal.

The sectional shape of the grooves 10*a* or recessed portions 110*a* of the male terminal 10 or 110 may be modified in any one of various shapes. It may have a wave form as shown in FIG. 3A, or a substantially triangular form as shown in FIG. 3B. Alternatively, it may have semi-spherical protruding portions between the grooves 10*a* or recessed portions 110*a* as shown in FIG. 3C. Furthermore, in the modified examples shown in FIGS. 3A through 3C, the distance c between two of the grooves 10*a* or recessed portions 110*a* adjacent to each other in the longitudinal directions of the male terminal 10 or 110 may be considered to be zero.

Figure 4:
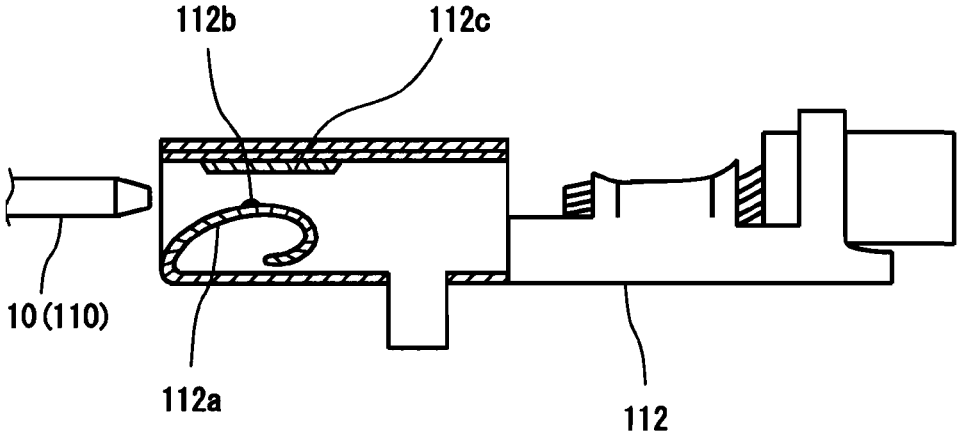
FIG. 4 is a partially cross-sectioned side view of a box-shaped connecting terminal as an example of a fitting type connecting terminal according to the present invention.

In place of the grooves 10*a* or recessed portions 110*a* formed in the male terminal 10 or 110, grooves or recessed portions having a similar shape to that of the grooves 10*a* or recessed portions 110*a* may be formed on the surface of the contact portion of a female terminal with the male terminal 10 or 110 which is designed to be fitted into the female terminal. For example, as shown in FIG. 4, when the preferred embodiment of a fitting type connecting terminal according to the present invention is applied to a box-shaped connecting terminal, in place of the grooves 10*a* or recessed portions 110*a* formed in the male terminal 10 or 110, grooves or recessed portions having a similar shape to that of the grooves 10*a* or recessed portions 110*a* may be formed on a semi-spherical indent (protruding contact portion) 112*b* provided on an elastic piece (spring portion) 112*a* of a female terminal 112 or may be formed on a raised portion (embossed portion) 112*c* of the female terminal 112 facing the elastic piece 112*a*.

When the male terminal 10 or 110 and the female terminal 12 are prepared from a tin-plated product wherein a thin flat plate of an electrically conductive base material having a thickness of 0.15 to 0.25 mm is plated with tin, the depth b of the grooves 10*a* or recessed portions 110*a* is preferably 80 μm or less and more preferably 70 μm or less, in order to prevent the tin-plated product from being broken.

Examples of a fitting type connecting terminal and a method for producing the same according to the present invention will be described below in detail.

Example 1

First, there were prepared two tin-plated products wherein a tin plating film (of Sn having a purity of 99.9 wt % or more) having a thickness of 1 μm was formed on a flat plate of an electrically conductive base material of a Cu—Ni—Sn alloy (NB109-EH produced by DOWA METALTECH CO., LTD.) having a thickness of 0.25 mm. One of the tin-plated products was pressed by a die to form a plurality of grooves having a width a of 100 μm, a depth b of 50 μm and a space c of 100 μm on one side thereof as shown in FIGS. 1A through 1C to be used as a grooved flat plate test piece (a test piece as a male terminal). The other tin-plated product was indented (embossed in a semi-spherical shape of R=1 mm) to be used as an indented test piece (a test piece as a female terminal).

Then, the grooved flat plate test piece was fixed to the stage of an electric minute sliding abrasion testing machine, and the indent of the indented test piece was caused to contact the grooved flat plate test piece. Thereafter, there was carried out a sliding test wherein the stage, to which the grooved flat plate test piece was fixed, was reciprocated in horizontal directions by 30 strokes at a sliding speed of one reciprocation per one second in a range of 200 μm per one-way while the indented test piece was pressed onto the surface of the grooved flat plate test piece at a load of 0.7 N. After this sliding test, the value of electrical resistance at the contact portion of the grooved flat plate test piece with the indented test piece was continuously measured by the four terminal method. As a result, the maximum value of electrical resistance during the sliding test was 2 mΩ. Furthermore, the oxide of abrasion powder (tin oxide powder) smaller than the width of each of the grooves fell into the grooves of the grooved flat plate test piece.

Example 2

There were prepared the same test pieces as those in Example 1, except that one of the tin-plated products was pressed by a die to form a plurality of recessed portions having a width a of 100 μm, a depth b of 50 μm and a space c of 100 μm as shown in FIGS. 2A and 2B. The test pieces thus prepared were used for measuring the value of electrical resistance at the contact portion by the same method as that in Example 1. As a result, the maximum value of electrical resistance during the sliding test was 2 mΩ. Furthermore, the oxide of abrasion powder (tin oxide powder) smaller than the width of each of the recessed portions fell into the recessed portions of the flat plate test piece having the recessed portions.

Comparative Example

There were prepared the same test pieces as those in Example 1, except that no grooves were formed in the one of the tin-plated products of Example 1. The test pieces thus prepared were used for measuring the value of electrical resistance at the contact portion by the same method as that in Example 1. As a result, the maximum value of electrical resistance during the sliding test was 248 mΩ. Furthermore, the oxide of abrasion powder (tin oxide powder) remaining on the flat plate test piece prevented the indent of the indented test piece from contacting the flat plate test piece. The size of abrasion powder aggregating on the flat plate test piece was 10 μm or less.

The invention claimed is:

1. A fitting type connecting terminal comprising a male terminal and a female terminal, each of the male and female terminals being made of a tin-plated electrically conductive base material, wherein a surface of a contact portion of one of the male and female terminals with the other of the male and female terminals has a plurality of grooves or recessed portions which are spaced from each other in longitudinal directions of the one of the male and female terminals, and wherein the grooves or recessed portions satisfy $d \leq b$, $d \leq a \leq L$ and $a+c \leq L$, assuming that each of the grooves or recessed portions has a width a (μm), a depth b (μm) and a distance c (μm) from an adjacent one of the grooves or recessed portions in the longitudinal directions and that the fitting type connecting terminal allows a sliding distance L (μm) between the male terminal and the female terminal in a state that the male terminal is fitted into and fixed to the female terminal, the fitting type connecting terminal producing an oxide of abrasion powder having a maximum grain size d (μm) due to sliding between the male terminal and the female terminal.

2. A fitting type connecting terminal as set forth in claim 1, wherein said plurality of grooves are elongated grooves which are spaced from each other at substantially even intervals in longitudinal directions of said male terminal and which extend in width directions of said male terminal, each of the grooves having a substantially rectangular planar shape.

3. A fitting type connecting terminal as set forth in claim 1, wherein said plurality of recessed portions are spaced from each other at substantially even intervals in longitudinal directions of the male terminal and spaced from each other at substantially even intervals in width directions of the male terminal, each of the recessed portions having corner portions which are arranged so as to be adjacent to the corner portions of an adjacent one or more of the recessed portions, and each of the recessed portions having a substantially rectangular planar shape.

4. A fitting type connecting terminal as set forth in claim 1, wherein said base material is made of copper or a copper alloy.

5. A fitting type connecting terminal as set forth in claim 1, wherein said electrically conductive base material is plated with tin having a purity of 99.9 wt % or more.

6. A fitting type connecting terminal as set forth in claim 1, wherein the fitting type connecting terminal is a box-shaped connecting terminal as a whole and has an elastic piece which is provided with the contact portion of said male terminal.

7. A fitting type connecting terminal as set forth in claim 1, wherein said sliding distance $\underline{L}$ is 1000 μm, and said maximum grain size $\underline{d}$ is 10 μm.

8. A fitting type connecting terminal as set forth in claim 1, wherein said sliding distance $\underline{L}$ is 250 μm, and said maximum grain size $\underline{d}$ is 30 μm.

9. A method for producing a fitting type connecting terminal which comprises a male terminal and a female terminal, each of the male and female terminals being made of a tin-plated electrically conductive base material, said method comprising the steps of:

forming grooves or recessed portions, which are spaced from each other in longitudinal directions, in a portion of a surface of an electrically conductive base material of one of the male and female terminals corresponding to a contact portion of the one of the male and female terminals with the other of the male and female terminals so that $d \leq b$, $d \leq a \leq L$ and $a+c \leq L$, are satisfied assuming that each of the grooves or the recessed portions is has a width $\underline{a}$ (μm), a depth $\underline{b}$ (μm) and a distance $\vec{c}$ (μm) from an adjacent one of the grooves or recessed portions in the longitudinal directions and that the fitting type connecting terminal allows a sliding distance $\underline{L}$ (μm) between the male terminal and the female terminal in a state that the male terminal is fitted into and fixed to the female terminal, the fitting type connecting terminal producing an oxide of abrasion powder having a maximum grain size $\underline{d}$ (μm) due to sliding between the male terminal and the female terminal; and thereafter, plating the electrically conductive base material of each of the male and female terminals with tin.

10. A method for producing a fitting type connecting terminal which comprises a male terminal and a female terminal, each of the male and female terminals being made of a tin-plated electrically conductive base material, said method comprising the steps of:

plating an electrically conductive base material of each of the male and female terminals; and thereafter, forming grooves or recessed portions, which are spaced from each other in longitudinal directions, in a surface of a contact portion of one of the male and female terminals with the other of the male and female terminals so that $d \leq b$, $d \leq a \leq L$ and $a+c \leq L$, are satisfied assuming that each of the grooves or the recessed portions has a width $\underline{a}$ (μm), a depth $\underline{b}$ (μm) and a distance $\underline{c}$ (μm) from an adjacent one of the grooves or recessed portions in the longitudinal directions and that the fitting type connecting terminal allows a sliding distance $\underline{L}$ (μm) between the male terminal and the female terminal in a state that the male terminal is fitted into and fixed to the female terminal, the fitting type connecting terminal producing an oxide of abrasion powder having a maximum grain size $\underline{d}$ (μm) due to sliding between the male terminal and the female terminal.

11. A method for producing a fitting type connecting terminal as set forth in claim 9 or 10, wherein said plurality of grooves are elongated grooves which are spaced from each other at substantially even intervals in longitudinal directions of said male terminal and which extend in width directions of said male terminal, each of the grooves having a substantially rectangular planar shape.

12. A method for producing a fitting type connecting terminal as set forth in claim 9 or 10, wherein said plurality of recessed portions are spaced from each other at substantially even intervals in longitudinal directions of the male terminal and spaced from each other at substantially even intervals in width directions of the male terminal, each of the recessed portions having corner portions which are arranged so as to be adjacent to the corner portions of an adjacent one or more of the recessed portions, and each of the recessed portions having a substantially rectangular planar shape.

13. A method for producing a fitting type connecting terminal as set forth in claim 9 or 10, wherein said base material is made of copper or a copper alloy.

14. A method for producing a fitting type connecting terminal as set forth in claim 9 or 10, wherein said electrically conductive base material is plated with tin having a purity of 99.9 wt % or more.

15. A method for producing a fitting type connecting terminal as set forth in claim 9 or 10, wherein the fitting type connecting terminal is a box-shaped connecting terminal as a whole and has an elastic piece which is provided with the contact portion of said male terminal.

16. A method for producing a fitting type connecting terminal as set forth in claim 9 or 10, wherein said sliding distance $\underline{L}$ is 1000 μm, and said maximum grain size $\underline{d}$ is 10 μm.

17. A method for producing a fitting type connecting terminal as set forth in claim 9 or 10, wherein said sliding distance $\underline{L}$ is 250 μm, and said maximum grain size $\underline{d}$ is 30 μm.

* * * * *